US005966744A

United States Patent [19]

Smith, Jr.

[11] Patent Number: 5,966,744

[45] Date of Patent: Oct. 19, 1999

[54] PROTECTIVE HELMET APPARATUS

[76] Inventor: James Smith, Jr., 1258 Sultan Cir., Carson, Calif. 90746

[21] Appl. No.: 09/153,119

[22] Filed: Sep. 15, 1998

[51] Int. Cl.[6] ..... A42B 3/20

[52] U.S. Cl. ..... 2/424; 2/9

[58] Field of Search ..... 2/424, 425, 9, 2/10, 15

[56] References Cited

U.S. PATENT DOCUMENTS

| | | | |
|---|---|---|---|
| D. 358,686 | 5/1995 | Kraemer . | |
| 3,608,089 | 9/1971 | Abbatelli | 2/9 |
| 3,815,152 | 6/1974 | Bednarczuk et al. | 2/9 |
| 3,889,296 | 6/1975 | Martin | 2/9 |
| 4,042,974 | 8/1977 | Morgan et al. | 2/9 |
| 4,233,687 | 11/1980 | Lancellotti | 2/9 |
| 4,677,694 | 7/1987 | Crow . | |
| 4,774,729 | 10/1988 | Coates et al. | 2/424 |
| 4,885,806 | 12/1989 | Heller . | |
| 4,885,807 | 12/1989 | Snow, Jr. | 2/424 |
| 5,129,108 | 7/1992 | Copeland et al. . | |
| 5,249,347 | 10/1993 | Martinitz . | |
| 5,384,914 | 1/1995 | Caveness et al. | 2/9 |
| 5,502,843 | 4/1996 | Strickland | 2/424 |
| 5,675,875 | 10/1997 | Servatius | 2/9 |

*Primary Examiner*—Michael A. Neas

[57] ABSTRACT

A helmet apparatus includes a head-covering assembly which includes a top portion and a side portion extending downward from the top portion. A guard support is connected to the side portion of the head-covering assembly, and a guard assembly is connected to the guard support. The helmet apparatus of the invention can be used as a batter's helmet to protect a batter in a baseball or softball game. The guard assembly can be installed when a player is batting, and the guard assembly can be easily removed when the player is no longer batting. The guard assembly includes a lower guard portion for covering a wearer's chin and an upper guard portion for covering a wearer's cheek. With a first embodiment of the invention, the guard support includes a guard support bracket, and the guard assembly includes bracket-connection portions for connecting to the guard support bracket. The guard support bracket includes a reception panel which includes a plurality of reception apertures. The bracket-connection portions of the guard assembly include hook members which are received in the reception apertures. The reception apertures are in a form of slots oriented longitudinally along the reception panel. With a second embodiment of the invention, the guard support includes grooves located in the side portion of the head-covering assembly, and the guard assembly includes tongue portions for connection with the grooves. The grooves extend horizontally along the side portion of the head-covering assembly.

4 Claims, 3 Drawing Sheets

PROTECTIVE HELMET APPARATUS

BACKGROUND OF THE INVENTION

1. Field of the Invention

The present invention relates generally to helmets and, more particularly, to helmets especially adapted for protecting portions of a wearer's face during baseball and softball games.

2. Description of the Prior Art

The general concept of protecting portions of a baseball or softball player's face during a game are known in the art and are exemplified by a number of innovations which have been developed and which are represented by the following U.S. Pat. Nos.: 4,677,694, 4,885,806, and Des. 358,686. More specifically, U.S. Pat. No. 4,677,694 discloses a facial protector for a batting helmet that includes a cheek and jaw protector that is secured to the helmet in a fixed location on the helmet. As a result, even when the player no longer needs the facial protection, such as after the player has batted and is on base, the cheek and jaw protector remains in its protective location. When not actually needed for protection, the cheek and jaw protector in its fixed protective location may be undesirable to the player. In this respect, it would be desirable if a helmet were provided that includes a cheek and jaw protector that is readily removable from the helmet when the cheek and jaw protector is not needed.

U.S. Pat. No. 4,885,806 discloses a batter's helmet that has a face protective member which can be moved around a spring loaded pivot from a face protecting location to an out of the way overhead location. In order to clear a brim on the helmet, the face protective member must extend a suitable distance forward of the wearer's face. As a result, the wearer's field of vision may be partially blocked by such a face protective member. In this respect, it would be desirable if a helmet were provided that includes a face protective member that extends out from a wearer's face a minimal distance to keep blocking the wearer's field of vision to a minimum.

Another aspect of U.S. Pat. No. 4,885,806 relates to the optical properties of the face protective member. More specifically, the face protective member is made from a continuous solid sheet material and includes a continuous opaque layer of padding under the solid sheet material. The continuous nature of the solid sheet and the padding cause a continuous opaque region to be created in the wearer's field of vision. To avoid such a continuous opaque region in the wearer's field of vision, it would be desirable if a helmet were provided that includes a face protective member that includes alternating opaque and transparent face protective regions.

U.S. Pat. No. Des. 358,686 discloses a faceguard for a batter's helmet that extends completely across the batter's face. Since when a batter faces a pitcher only one half of the batter's face is turned towards the pitcher, it would be desirable if a helmet were provided that includes a faceguard that extends across only one half of the batter's face.

In addition, the following U.S. patents disclose some additional innovations for protecting a player's face in sports other than baseball or softball. Each of U.S. Pat. No. 5,129,108 and U.S. Pat. No. 5,249,347 discloses a face mask to be worn by hockey players. Both of these face masks cover both sides of the player's face.

Still other features would be desirable in a protective helmet apparatus. For example, it would be desirable if a protective helmet apparatus included a face protective portion that could be slid to the side of the helmet when the face protective portion is not being used.

Thus, while the foregoing body of prior art indicates it to be well known to use helmets that have protective devices for a wearer's face, the prior art described above does not teach or suggest a protective helmet apparatus which has the following combination of desirable features: (1) includes a cheek and jaw protector that is readily removable from the helmet when the cheek and jaw protector is not needed; (2) includes a face protective member that extends out from a wearer's face a minimal distance to block the wearer's field of vision at a minimum; (3) includes a face protective member that includes alternating opaque and transparent face protective regions; (4) includes a faceguard that extends across only one half of the batter's face; and (5) includes a face protective portion that can be slid to the side of the helmet when the face protective portion is not being used. The foregoing desired characteristics are provided by the unique protective helmet apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a helmet apparatus which includes a head-covering assembly which includes a top portion and a side portion extending downward from the top portion. A guard support is connected to the side portion of the head-covering assembly, and a guard assembly is connected to the guard support. The helmet apparatus of the invention can be used as a batter's helmet to protect a batter in a baseball or softball game. The guard assembly can be installed when a player is batting, and the guard assembly can be easily removed when the player is no longer batting, such as when the player is on base. The guard assembly includes a lower guard portion for covering a wearer's chin and an upper guard portion for covering a wearer's cheek.

With a first embodiment of the invention, the guard support includes a guard support bracket, and the guard assembly includes bracket-connection portions for connecting to the guard support bracket. The guard support bracket includes a reception panel which includes a plurality of reception apertures. The bracket-connection portions of the guard assembly include hook members which are received in the reception apertures. The reception apertures are in a form of slots oriented longitudinally along the reception panel.

With a second embodiment of the invention, the guard support includes grooves located in the side portion of the head-covering assembly, and the guard assembly includes tongue portions for connection with the grooves. The grooves extend horizontally along the side portion of the head-covering assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective helmet apparatus which has all of the advantages of the prior art and none of the disadvantages.

It is another object of the present invention to provide a new and improved protective helmet apparatus which may be easily and efficiently manufactured and marketed.

It is a further object of the present invention to provide a new and improved protective helmet apparatus which is of durable and reliable construction.

An even further object of the present invention is to provide a new and improved protective helmet apparatus which is susceptible of a low cost of manufacture with regard to both materials and labor, and which accordingly is then susceptible of low prices of sale to the consuming public, thereby making such protective helmet apparatus available to the buying public.

Still yet a further object of the present invention is to provide a new and improved protective helmet apparatus which includes a cheek and jaw protector that is readily removable from the helmet when the cheek and jaw protector is not needed.

Still another object of the present invention is to provide a new and improved protective helmet apparatus that includes a face protective member that extends out from a wearer's face a minimal distance to block the wearer's field of vision at a minimum.

Yet another object of the present invention is to provide a new and improved protective helmet apparatus which includes a face protective member that includes alternating opaque and transparent face protective regions.

Even another object of the present invention is to provide a new and improved protective helmet apparatus that includes a faceguard that extends across only one half of the batter's face.

Still a further object of the present invention is to provide a new and improved protective helmet apparatus which includes a face protective portion that can be slid to the side of the helmet when the face protective portion is not being used.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
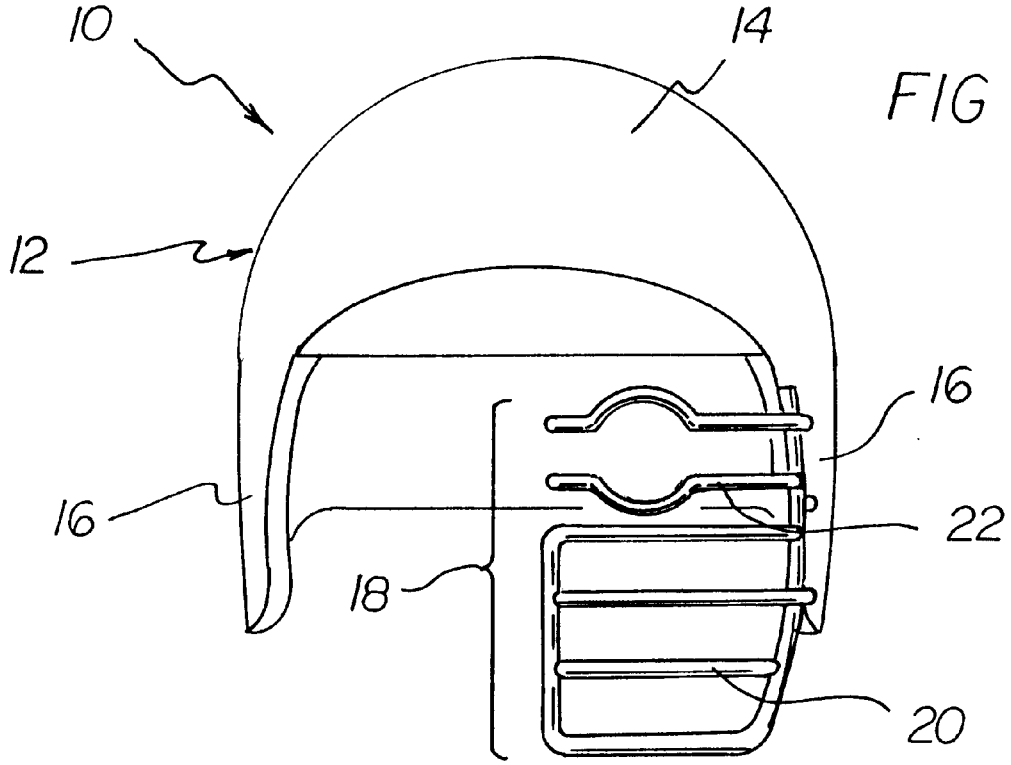
FIG. 1 is a front view showing a first embodiment of the protective helmet apparatus of the invention.

With reference to the drawings, a new and improved protective helmet apparatus embodying the principles and concepts of the present invention will be described.

In general, the helmet apparatus 10 includes a head-covering assembly 12 which includes a top portion 14 and a side portion 16 extending downward from the top portion 14. A guard support is connected to the side portion 16 of the head-covering assembly 12, and a guard assembly 18 is connected to the guard support. The helmet apparatus 10 of the invention can be used as a batter's helmet to protect a batter in a baseball or softball game. The guard assembly 18 can be installed when a player is batting, and the guard assembly 18 can be easily removed when the player is no longer batting, such as when the player is on base. The guard assembly 18 includes a lower guard portion 20 for covering a wearer's chin and an upper guard portion 22 for covering a wearer's cheek.

Figure 2:
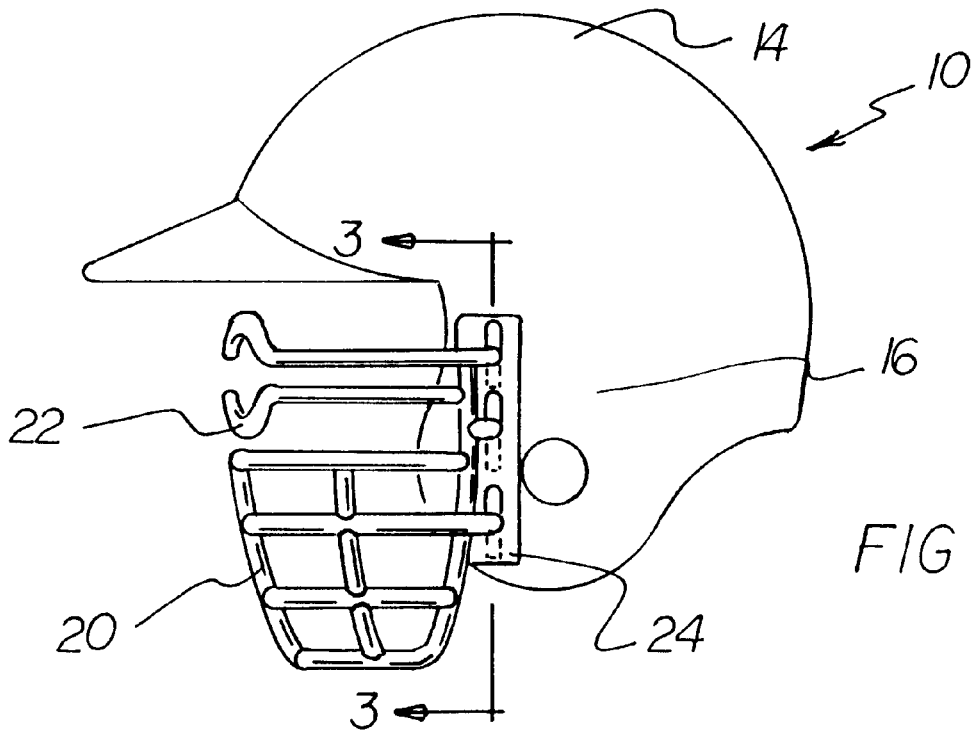
FIG. 2 is a side view of the embodiment of the protective helmet apparatus shown in FIG. 1.
Figure 3:
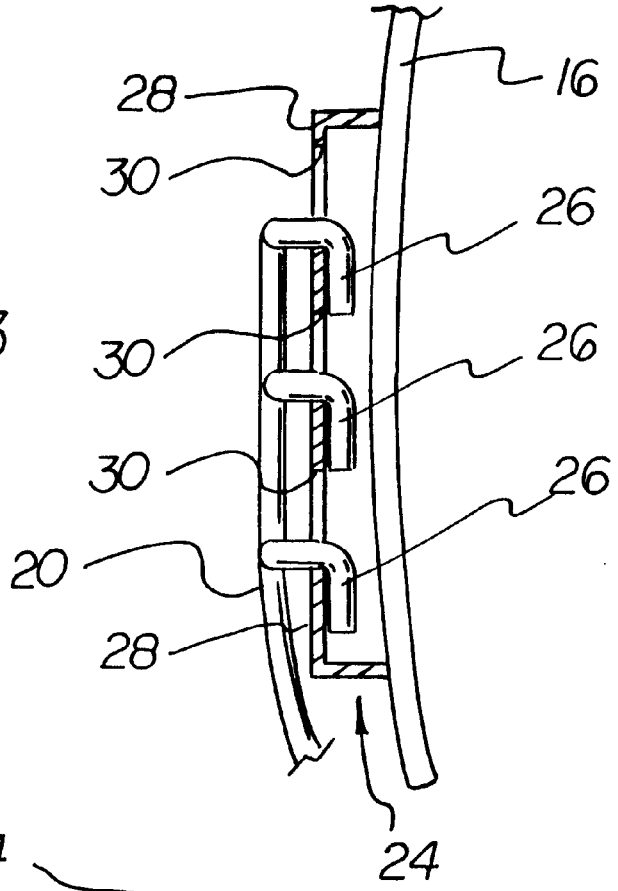
FIG. 3 is an enlarged partial cross-sectional view of the embodiment of the protective helmet apparatus of FIG. 2 taken along line 3—3 thereof.

In accordance with the first embodiment of the invention shown in FIGS. 1–3, the guard support includes a guard support bracket 24, and the guard assembly 18 includes bracket-connection portions for connecting to the guard support bracket 24. The guard support bracket 24 includes a reception panel 28 which includes a plurality of reception apertures 30. The bracket-connection portions of the guard assembly 18 include hook members 26 which are received in the reception apertures 30. The reception apertures 30 are in a form of slots 30 oriented longitudinally along the reception panel 28.

With the first embodiment of the protective helmet apparatus of the invention, when a player is at bat, the guard assembly 18 is installed on the bracket-connection portions. More specifically, the hook members 26 of the guard assembly 18 are inserted through the slots 30 in the reception panel 28 of the guard support bracket 24. The rear faces of the hook members 26 rest upon rear surfaces of the reception panel 28. In this manner, the reception panel 28 carries the guard assembly 18.

Once the player is no longer at bat, such as when the player reaches a base, the guard assembly 18 is pushed upward and pulled outward. In this way, the hook members 26 are removed from their contact with the reception panel 28 and pulled away from the slots 30 in the reception panel 28. The player can then continue to wear the head-covering assembly 12 without the benefit of the guard assembly 18.

When the player is at bat again, the hook members 26 of the guard assembly 18 can be pushed through the slots 30, and the guard assembly 18 can be lowered, whereby the rear portions of the hook members 26 rest against the rear portion of the reception panel 28, and the guard assembly 18 is supported by the reception panel 28.

Figure 4:
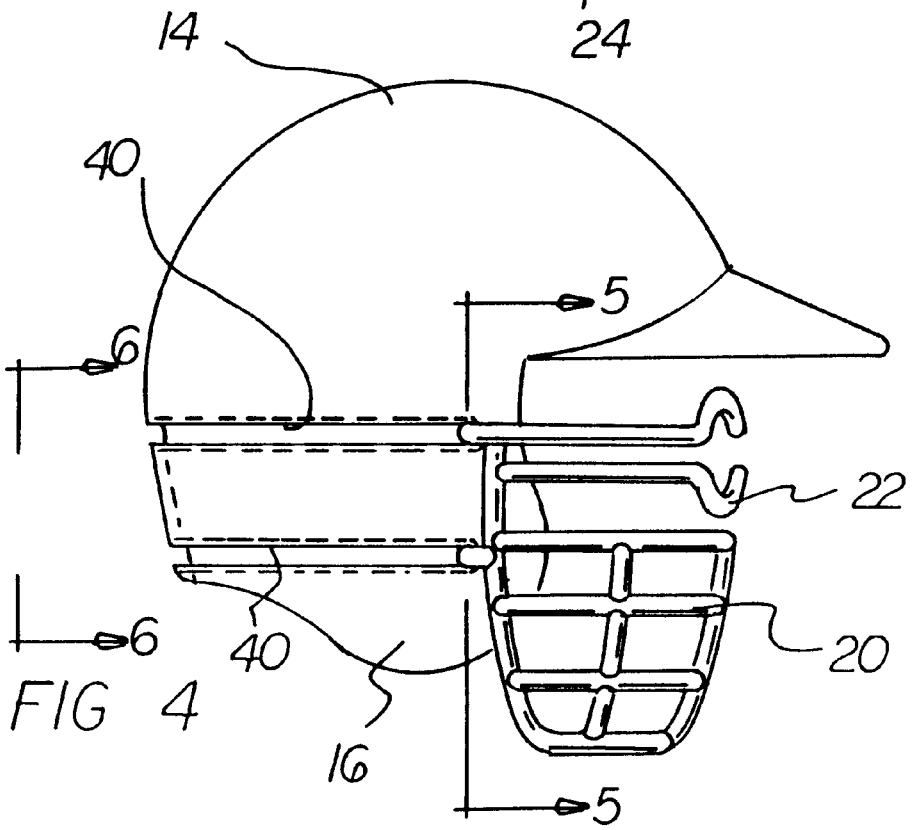
FIG. 4 is a side view of a second embodiment of the invention.
Figure 5:
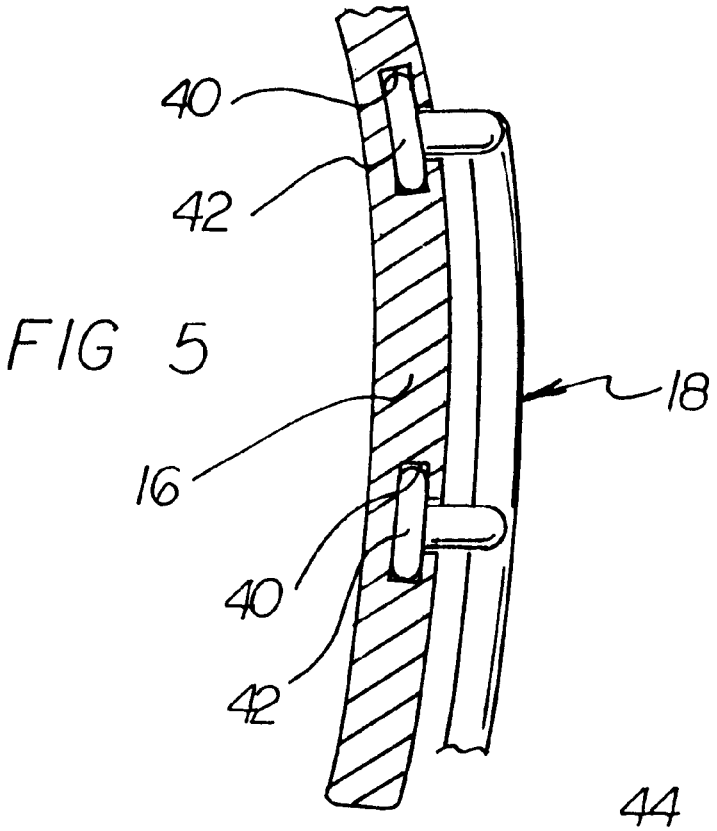
FIG. 5 is an enlarged partial cross-sectional view of a second embodiment of the invention taken along line 5—5 of FIG. 4.
Figure 6:
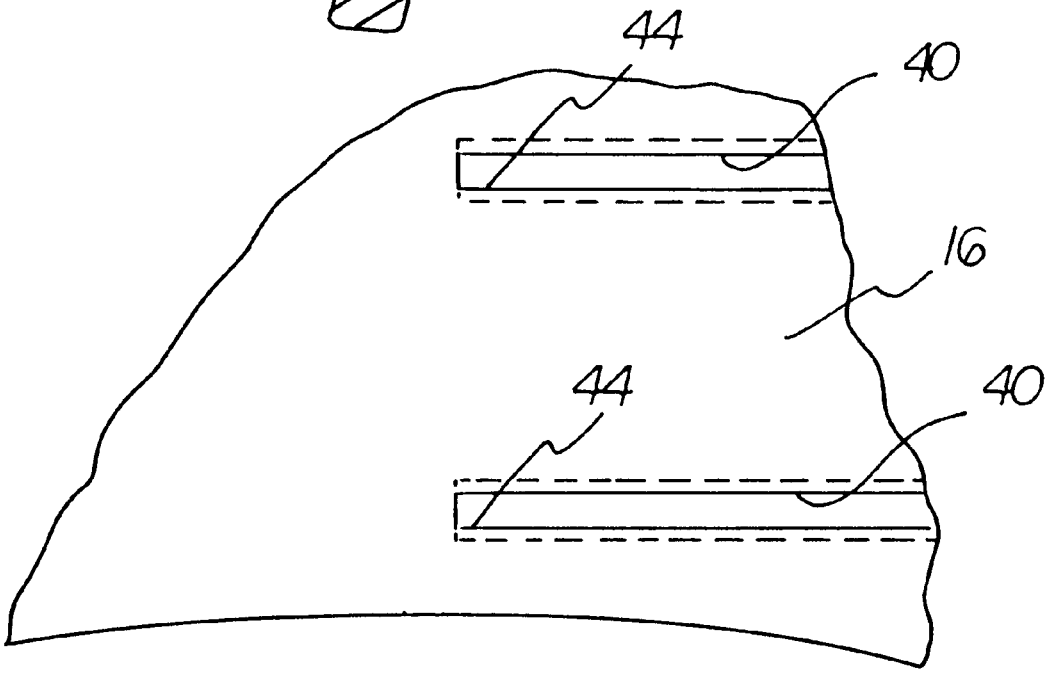
FIG. 6 a partial rear view of the second embodiment of the invention shown in FIG. 4 taken along line 6—6 thereof.

In accordance with the second embodiment of the helmet apparatus 10 of the invention shown in FIGS. 4–6, the guard support includes grooves 40 located in the side portion 16 of the head-covering assembly 12, and the guard assembly 18 includes tongue portions 42 for connection with the grooves 40. The grooves 40 extend horizontally along the side portion 16 of the head-covering assembly 12.

To use the second embodiment of the helmet apparatus 10 of the invention, the tongue portions 42 of the guard assembly 18 are inserted in the open ends 44 of the grooves 40, and the guard assembly 18 is pulled forward. In this way, the tongue portions 42 slide forward in the grooves 40 until the guard assembly 18 is in position at the front of the helmet apparatus 10. When the player is at bat, the guard assembly 18 is installed as just described. However, when the player is no longer at bat, the guard assembly 18 is pushed rearward, and the tongue portions 42 slide in the grooves 40 rearwardly until they exit from the open ends 44 of the grooves 40. In this way, with the second embodiment of the invention, the guard assembly 18 is removed from the head-covering assembly 12. Reinstallation of the guard assembly 18 on the head-covering assembly 12 is as described above.

The components of the protective helmet apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved protective helmet apparatus that is low in cost, relatively simple in design and operation, and which includes a cheek and jaw protector that is readily removable from the helmet when the cheek and jaw protector is not needed. With the invention, a protective helmet apparatus is provided which includes a face protective member that extends out from a wearer's face a minimal distance to block the wearer's field of vision at a minimum. With the invention, a protective helmet apparatus is provided which includes a face protective member that includes alternating opaque and transparent face protective regions. With the invention, a protective helmet apparatus is provided which includes a faceguard that extends across only one half of the batter's face. With the invention, a protective helmet apparatus is provided which includes a face protective portion that can be slid to the side of the helmet when the face protective portion is not being used.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A helmet apparatus, comprising:

a head-covering assembly which includes a top portion and a side portion extending downward from said top portion, guard support means connected to said side portion of said head-covering assembly, a guard assembly connected to said guard support means, wherein said guard support means includes a guard support bracket, said guard assembly includes bracket-connection portions for connecting to said guard support bracket, said guard support bracket further includes a reception panel which includes a plurality of reception apertures, said bracket-connection portions of said guard assembly includes hook members which are received in said reception apertures, and wherein said reception apertures are in a form of slots oriented longitudinally along said reception panel.

2. The apparatus of claim 1 wherein said guard assembly includes:

a lower guard portion for covering a wearer's chin, and an upper guard portion for covering a wearer's cheek.

3. A helmet apparatus, comprising:

a head-covering assembly which includes a top portion and a side portion extending downward from said top portion, guard support means connected to said side portion of said head-covering assembly, a guard assembly connected to said guard support means, wherein:

said guard support means include grooves located in said side portion of said head-covering assembly, and said guard assembly includes tongue portions for connection with said grooves.

4. The apparatus of claim 3 wherein said grooves extend horizontally along said side portion of said head-covering assembly.

* * * * *